US007335077B2

(12) United States Patent
Chiappetta

(10) Patent No.: US 7,335,077 B2
(45) Date of Patent: Feb. 26, 2008

(54) MAN OVERBOARD DETECTION AND RESCUE SYSTEM

(76) Inventor: Anthony Chiappetta, 4050 E. Greenway, #4, Phoenix, AZ (US) 85032

( * ) Notice: Subject to any disclaimer, the term of this patent is extended or adjusted under 35 U.S.C. 154(b) by 0 days.

(21) Appl. No.: 11/410,994

(22) Filed: Apr. 25, 2006

(65) Prior Publication Data

US 2007/0249245 A1 Oct. 25, 2007

(51) Int. Cl.
*B63C 9/00* (2006.01)

(52) U.S. Cl. ..... 441/80

(58) Field of Classification Search ..... 441/80
See application file for complete search history.

(56) References Cited

U.S. PATENT DOCUMENTS 4,305,143 A * 12/1981 Simms et al. ..... 367/134
5,021,765 A * 6/1991 Morgan ..... 340/539.23
5,886,635 A * 3/1999 Landa et al. ..... 340/573.6

* cited by examiner

*Primary Examiner*—Jesús D Sotelo
(74) *Attorney, Agent, or Firm*—Tod R. Nissle, P.C.

(57) ABSTRACT

A system detects a man overboard and facilitates the rescue of the overboard individual. The system includes sensors that provide surveillance of a peripheral envelope of a boat to detect when an individual fall through the envelope. When an individual is detected falling through the peripheral envelope, an alarm is sounded and a floatation device is dispensed into the water.

4 Claims, 1 Drawing Sheet

MAN OVERBOARD DETECTION AND RESCUE SYSTEM

This invention pertains to water craft.

More particularly, this invention pertains to a method and apparatus for detecting when a passenger on a boat falls overboard, and for facilitating the rescue of the passenger.

Each year, passengers on cruise ships and other vessels fall overboard and are not detected as missing until it is too late to attempt to locate or rescue the passengers.

Accordingly, it would be highly desirable to provide an improved method and apparatus for detecting and rescuing a man overboard.

Therefore, it is a principal object of the instant invention to provide an improved method and apparatus for detecting when a passenger on a vessel falls overboard.

Another object of the invention is to facilitate the rescue of a man or woman overboard.

Figure 1:
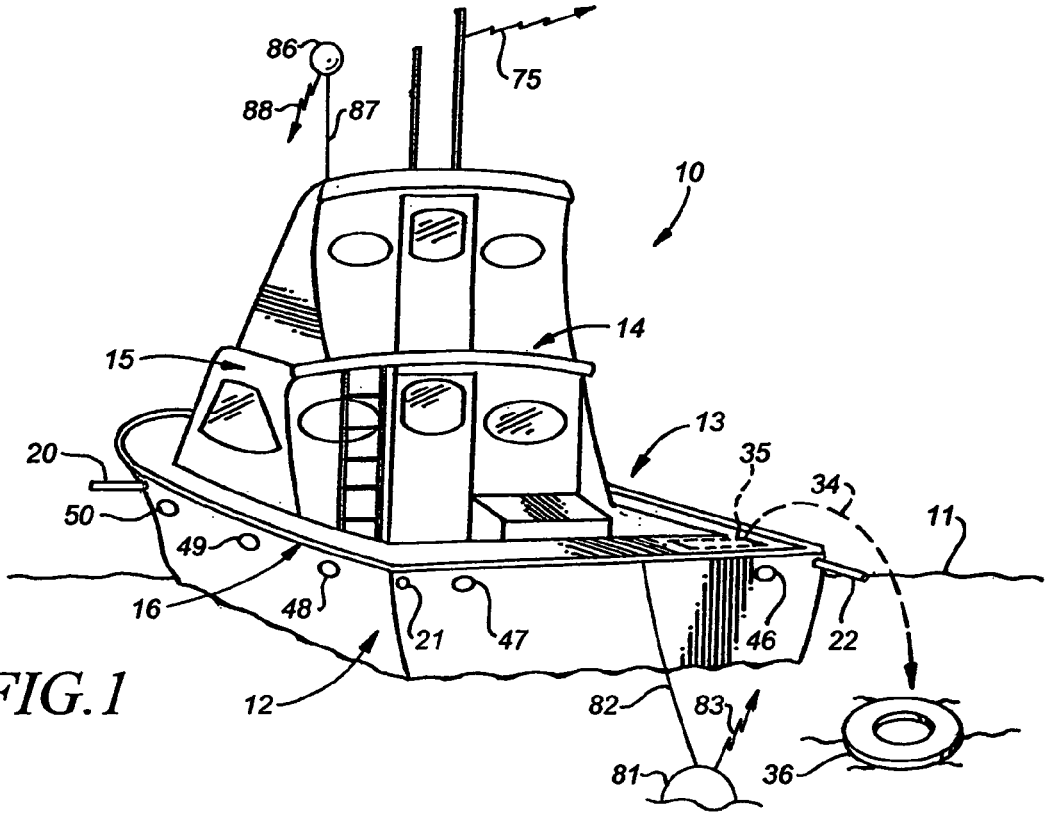
Figure 2:
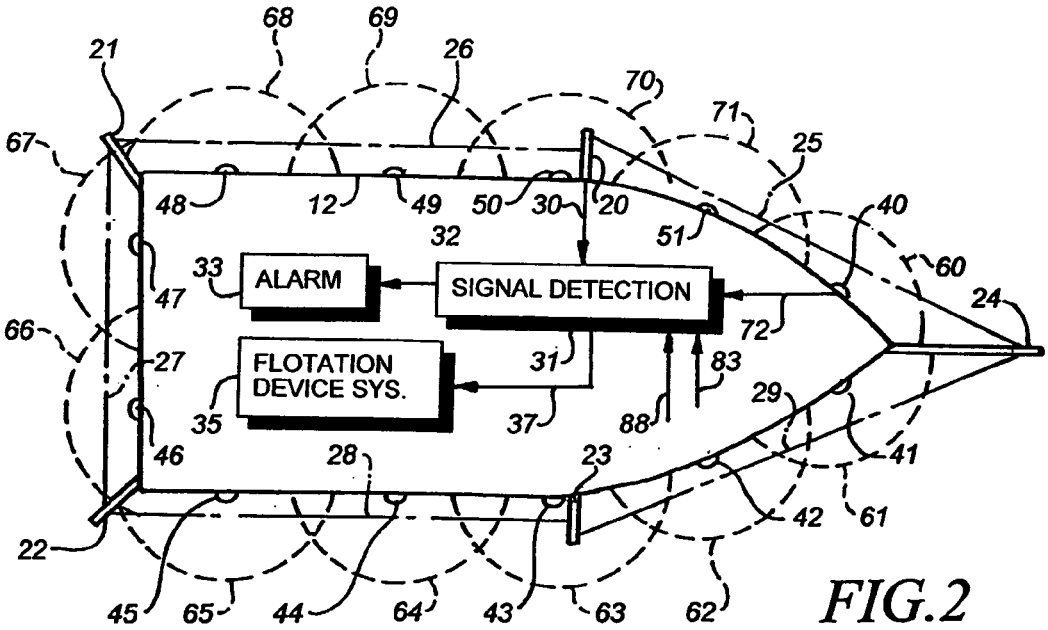

These and other, further and more specific objects and advantages of the invention will be apparent from the following detailed description of the invention, taken in conjunction with the drawings, in which:

FIG. 1 is a perspective view illustrating a boat equipped with a detection system constructed in accordance with the invention; and, FIG. 2 is a top view of the boat of FIG. 1 further illustrating construction details of the invention.

Briefly, in accordance with my invention, I provide an improved method to detect on a boat a man overboard. The boat includes a hull and at least one deck. The method includes selecting a peripheral area adjacent the boat through which a man overboard from the deck would fall; providing at least one sensor to detect when a man overboard from the deck falls through the peripheral area and to generate an alarm signal; providing an alarm; providing an alarm activation system to receive the alarm signal and activate the alarm; and, installing the sensor, alarm, and alarm system on the boat to detect with the sensor when a man overboard falls through the peripheral area, and to activate the alarm.

In another embodiment of the invention, I provide an improved method to detect on a boat a man overboard. The boat includes an upper deck. The method includes the steps providing an automated sensor system for detecting the body of a human being falling overboard and past the upper deck; and, installing the automated sensor system on the boat.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates a boat 10 on a body of water 11. As used herein, a body of water is a lake that is man-made or occurs naturally, is an ocean, or is a sea. Sea level is the elevation of the upper surface of the body of water.

Boat 10 includes a hull 12, upper deck 13, deck 14 above upper deck 13, and cabin 15. The upper deck of a boat is the highest deck that extends the full length of the boat and that includes at least a section from which a person could fall from the deck overboard, either straightaway (i.e., there is no railing) or over a railing at the edge of the deck. As used herein, the term boat generally includes boats of any size, including, but not limited to, barges, small power boats and sail boats, and large ocean going ships.

In the method of the invention, the initial step is to select at least one elevation (i.e., the vertical height or distance from the bottom of boat 10) on the boat at or along which a sensor, or sensor system, should detect an man falling overboard through a peripheral area adjacent the boat. This elevation typically generally coincides with the elevation of the upper deck 13. Sensors positioned at the elevation of the upper deck typically will detect an individual falling from a deck 14 above deck 13 into the body of water 11. The decks below the upper deck, including the main deck, ordinarily lie within the hull of the boat, can be sealed during storms, and, although there may be portholes or windows or the deck, the portholes normally do not open. If the portholes do open, they usually are sized such that an individual will not fit, or will not readily fit, through the porthole. If it is possible for a child or adult to fit through such a porthole, the porthole can be provided with its own sensor system, or, the elevation selected can coincide to the elevation of the porthole(s), or to an elevation below the portholes. In the case of larger vessels, doors may be provided nearer the water line for boarding and disembarking the vessel. The elevation of the sensor(s) can be selected to detect individuals falling out through such doors, or, such doors can be provided with a separate sensor to detect when the doors are opened or when an individual falls through the doors into the body of water. If the sensors are placed too close to the surface of the body of water 11, then surface waves encountered during normal non-stormy weather may activate the sensors. This preferably is to be avoided.

In another embodiment of the invention, one or more buoys 81 or other devices tethered 82 to boat 10 generate signals that scan the area around boat 10 and, when an object is detected falling from boat 10 into the water, generate a signal 83 that is received by system 31. System 31 generates a signal 32 to activate alarm 33. The device can be positioned beneath the surface of body of water 11 and need not be buoyant. Typically, however, the device will function as a buoy 81 and float. Buoys 81 can be attached to boat 10 such that the buoys are at the back or side (s) of boat 10 when boat 10 is anchored or is moving. Two or more buoys 81 can be utilized such that signals from one buoy pass through a peripheral envelope adjacent boat 10 and are received by another buoy.

In a further embodiment of the invention, one or more balloon apparatus 86 or other lighter-than-air systems is tethered 87 to boat 10 and generates signals that scan the area around boat 10 to determine if a man or woman fall overboard. If apparatus 86 detects a man overboard, apparatus 86 generates a signal 88 (wireless or by wire) to system 31. System 31 generates a signal 32 to alarm 33 to activate alarm 33. Each apparatus 86 can be positioned at any desired location above boat 10, to the side of boat 10, and/or outside the periphery of boat 10. Two or more balloon apparatus can be utilized in conjunction with each other such that signals from one balloon apparatus passes through a selected peripheral envelope adjacent boat 10 and are received by another balloon apparatus.

In still other embodiments of the invention, sensor systems are positioned inside of boat 10 or in the body of water 11 under or outside the hull 12. Any desired sensor system can be utilized as long as the system can detect a man or woman falling off boat 10 into body of water 11.

Assume, for sake of discussion, that the elevation selected for boat 10 corresponds to the elevation 16 of the upper deck 13. The sensor system selected and installed on boat 10 is able to detect an individual falling from deck 13 or deck 14 through an space adjacent to, outside of, and peripheral to deck 13.

One sensor system comprises a plurality of arms 20, 21, 22, 23, 24 attached to and extending outwardly from hull 12. A light beam 26 produced by a laser, fiber optic, or other light source (not visible) in one arm 21 extends adjacent hull 12 and is detected by a sensor (not visible) on operatively associated arm 20. If the light beam 26 is broken, and the sensor in arm 20 does not receive the beam 26, the sensor immediately generates a signal 30 that is received by signal detection system 31. System 31 generates a signal 32 to activate an alarm 33 on board boat 10. The alarm can be visual (i.e. flashing light), audible (i.e., horn), or any other desired kind of alarm. The alarm preferably is located and operates such that at least one individual on the boat 10 will be able to detect the alarm, and such that the alarm will be detected twenty-four hours a day by one or more individuals assigned to monitor the alarm. Consequently, it is assumed that there normally are at least two individuals on the boat so that in the event one individual falls overboard the remaining individual will be alerted by the alarm. However, even in the event there is only a single individual on board, the system of the invention can be useful if, when beam 26 is broken, the signal detection system 31 generates a signal 32 that is transmitted to and received by a monitoring station remote from boat 10.

Light beam 25 is generated by a light source in arm 20 and received by a sensor in arm 24. Light beam 29 is generated by a light source in arm 24 and is received by a sensor in arm 23. Light beam 28 is generated by a light source in arm 23 and is received by a sensor in arm 22. Light beam 27 is generated by a light source in arm 22 and is received by a sensor in arm 21. If a beam 25, 29, 28, 27 is broken, the sensor in arm 24, 23, 22, 21, respectively, generates a signal to signal detection system 31. In response, signal detection system 31 then generates a signal 32 to activate an alarm 33 on board boat 10.

Any desired sensor system can be utilized in the practice of the invention. For example, an alternate sensor system includes one or more motion detectors 40 to 51 each mounted on hull 12 of boat 10. Each detector 40 to 51 is set, or calibrated to scan and detect motion in a selected space or volume or envelope, 60 to 71, respectively, adjacent the detector. The shape of the envelope 60 to 71 can vary as desired and might, for example, be semi-spherical or comprises a quarter of a sphere. It is preferred that the selected spaces 60 to 71 overlap in the manner illustrated in FIG. 2 so that detectors can sense a man overboard regardless of from where on boat 10 the individual falls into the body of water 11 surrounding the boat. A detector 40 to 51 can also be calibrated to react to an object of a selected size so that if a bird or small object is detected moving through an envelope 60 to 71, a signal 30 is not generated to system, and, so that a signal 30 is generated only if a larger object of selected size is detected moving through an envelope 60 to 71. An envelope 60 to 71 can extend in any desired direction, including, but not limited to, outwardly from boat 10 and hull 12, downwardly from sensor 40 to 51, and upwardly from sensor 40 to 51. In the event any detector 40 does sense an individual passing (i.e., falling) through the space scanned by the detector, the detector generates a signal 72 to signal detection system 31. System 31 then generates a signal 32 to alarm 33 or to a monitoring station (not shown) remote from boat 10. A signal generated to a remote monitoring is typically, but not necessarily, wireless 75.

When signal detection system 31 receives a signal 20 or 72, system 31 can also generate a signal 37 to a floatation device system 35. System 35 automatically ejects 34 into body of water 11 a life jacket, raft, or other floatation device 36 that can be utilized by a man or woman overboard. The construction of system 35 can vary as desired. The floatation device 26 normally will be ejected or dropped into the ambient atmosphere to land on the surface of body of water 11. It is also possible, however, for the floatation device to be ejected from boat 10 into body of water 11 to rise up to and float on the surface of body of water 11.

Having described my invention in such terms as to enable those of skill in the art to make and practice it, and having described the presently preferred embodiments thereof, I Claim:

1. A method to detect on a boat afloat on water a man overboard, the boat including a hull and a deck, the method comprising the steps of (a) providing a sensor system to detect the movement through the air above the water of the body of a human being that falls overboard from the deck and travels through the air above and toward the water; and, (b) installing said sensor system on the boat.

2. The method of claim 1

(a) including the additional step intermediate steps (a) and (b) of selecting at least one peripheral area adjacent the boat and above the water through which said body could move while falling through the air above and toward the water; and, (b) wherein in step (b) said sensor system is installed on the boat to monitor said peripheral area and detect when said body moves through said peripheral area while falling through the air above and toward the water.

3. The method of claim 2 wherein said sensor system comprises (a) at least a pair of spaced apart arms (20), (21), (22), (23), (24) attached to and extending outwardly from said hull above the water;

(b) at least one light beam traveling between said arms (20), (21); and, (c) a sensor system to detect when said light beam is broken by said body moving through said peripheral area while falling through the air above and toward the water.

4. The method of claim 2 wherein said sensor system comprises at least one motion detector (40), (41), (42), (43), (44), (45), (46), (47), (48), (49), (50), (51) mounted on the boat above the water to detect when said body moves through said peripheral area while falling through the air above and toward the water.

* * * * *